US007660718B2

(12) United States Patent
Padhi et al.

(10) Patent No.: US 7,660,718 B2
(45) Date of Patent: Feb. 9, 2010

(54) PITCH DETECTION OF SPEECH SIGNALS

(75) Inventors: Kabi Prakash Padhi, Singapore (SG); Sapna George, Singapore (SG)

(73) Assignee: STMicroelectronics Asia Pacific Pte. Ltd., Singapore (SG)

( * ) Notice: Subject to any disclaimer, the term of this patent is extended or adjusted under 35 U.S.C. 154(b) by 847 days.

(21) Appl. No.: 10/948,950

(22) Filed: Sep. 23, 2004

(65) Prior Publication Data

US 2005/0149321 A1 Jul. 7, 2005

(30) Foreign Application Priority Data

Sep. 26, 2003 (SG) ..... 200305743-7

(51) Int. Cl.
*G10L 13/00* (2006.01)

(52) U.S. Cl. ..... 704/268; 704/205; 704/207

(58) Field of Classification Search ..... 704/268, 704/205, 207

See application file for complete search history.

(56) References Cited

U.S. PATENT DOCUMENTS 5,536,902 A * 7/1996 Serra et al. ..... 84/623
5,884,010 A * 3/1999 Chen et al. ..... 704/228
5,884,253 A * 3/1999 Kleijn ..... 704/223
6,766,288 B1 * 7/2004 Smith ..... 704/207
7,149,682 B2 * 12/2006 Yoshioka et al. ..... 704/205
2001/0045153 A1 * 11/2001 Alexander et al. ..... 84/609
2003/0204543 A1 * 10/2003 Yoon et al. ..... 708/300
2004/0128130 A1 * 7/2004 Rose et al. ..... 704/236

OTHER PUBLICATIONS

S.S. Abeysekera et al., "Investigation of different frequency estimation techniques using the phase vocoder," *International Symposium on Circuits and Systems*, May 2001, pp. 265-268.

R.C. Maher et al., "Fundamental frequency estimation of musical signals using a two-way mismatch procedure," *Journal of the Acoustical Society of America*, vol. 95, No. 4, Apr. 1994, pp. 2254-2263.

(Continued)

*Primary Examiner*—David R Hudspeth
*Assistant Examiner*—Jakieda R Jackson
(74) *Attorney, Agent, or Firm*—David V. Carlson; Lisa K. Jorgenson

(57) ABSTRACT

Pitch detection of speech signals finds numerous applications in karaoke, voice recognition and scoring applications. While most of the existing techniques rely on time domain methods, the invention utilizes frequency domain methods. There is provided a method and system for determining the pitch of speech from a speech signal. The method includes the steps of: producing or obtaining the speech signal; distinguishing the speech signal into voiced, unvoiced or silence sections using speech signal energy levels; applying a Fourier Transform to the speech signal and obtaining speech signal parameters; determining peaks of the Fourier transformed speech signal; tracking the speech signal parameters of the determined peaks to select partials; and determining the pitch from the selected partials using a two-way mismatch error calculation.

41 Claims, 13 Drawing Sheets

OTHER PUBLICATIONS

M.R. Portnoff, "Implementation of the Digital Phase Vocoder Using the Fast Fourier Transform," *IEEE Transactions on Acoustics, Speech and Signal Processing*, vol. ASSP-24, No. 3, Jun. 1976, pp. 243-248.

T.F. Quatieri et al., "Speech Transformations Based on a Sinusoidal Representation," *IEEE Transactions on Acoustics, Speech and Signal Processing*, vol. ASSP-34, No. 6, Dec. 1986, pp. 1449-1464.

J.O. Smith, "Mathematics of the Discrete Fourier Transform (DFT)," http://ccrma.stanford.edu/~jos/mdft/, 2003, ISBN 0-9745607-0-7.

J.O. Smith, "The window method for digital filter design," Winter 1992, Mathematica notebook for Music 420 (EE 367A), URL: ftp://ccrma-ftp.standford.edu/pub/DSP/Tutorials/Kaiser.ma.Z.

* cited by examiner (A)

(B)

PITCH DETECTION OF SPEECH SIGNALS

BACKGROUND OF THE INVENTION

1. Field of the Invention

The present invention relates to the pitch detection of speech signals for various applications, and in particular, to a method and system providing pitch detection of speech signals for use in various audio effects, karaoke, scoring, voice recognition, etc.

2. Description of the Related Art

Pitch detection of speech signals finds applications in various audio effects, karaoke, scoring, voice recognition, etc. The pitch of a signal is the fundamental frequency of vibration of the source of the tone.

Speech signals can be segregated into two segments: voiced; and unvoiced speech. Voiced speech is produced using the vocal cords and is generally modeled as a filtered train of impulses within a frequency range. Unvoiced speech is generated by forcing air through a constriction in the vocal tract. Pitch detection involves the determination of the continuous pitch period during the voiced segments of speech.

The terms "speech" and "speech signal" are a broad reference to all forms of generated audio or sound. For example, "speech" and its associated "speech signal" can refer to talking, singing, attempted singing, whistling, humming, a recital, etc. The "speech" and "speech signal" can originate from an individual or a group, being human, animal or otherwise. The "speech" could also be artificially generated, for example by a computer or other electronic device.

There exist presently known techniques for pitch detection (see W. Hess, "Pitch Determination of Speech Signals: Algorithms and Devices", Springer-Verlag, 1983). A time based pitch detector, estimates the pitch period by determining the glottal closure instant (GCI) and measuring the time period between each "event". Frequency domain pitch detection can then be used to determine the pitch. Thus, the speech signal is processed period-by-period.

Autocorrelation Techniques

Correlation is the measure of similarity of two input functions, and in the case of the autocorrelation function Γ(d), the input functions are the same signal x(n), as shown in Equation 1, $$\Gamma(d) = \lim_{N\to\infty} \frac{1}{2\cdot N+1} \sum_{n=-N}^{+N} x(n)\cdot x(n+d) \tag{1}$$

where, d represents the lag or delay between the signal and a delayed segment, and N represents the number of samples of the input under consideration. If the signal is periodic or quasi-periodic, the similarities between x(n) and x(n+d) are higher. The correlation coefficients are also high if the lag is equal to a period or a multiple of a period.

As the autocorrelation function (ACF) is the Inverse Fourier Transform of the power spectrum of the input signal, the pitch is chosen as the frequency ($f_s$/d) at which the maximum of the ACF occurs; i.e., where $f_s$ is the sampling frequency of the speech signal. Complications due to unknown phase relations and formant structures do not arise, as the technique is independent of these parameters.

Average Magnitude Difference Function

Signals that are similar do not exhibit a lot of differences. Thus, periodicity can be detected by investigation of the global deviation between the signals. The Average Magnitude Difference Function (AMDF) is defined as follows:

$$AMDF(d) = \frac{1}{K} \sum_{n=q}^{q+K-1} |x(n) - x(n+d)| \tag{2}$$

where, K is the number of samples in a frame and q is the initial sample of the frame. AMDF has a strong minimum when the lag d is equal to the period of the input x(n). This minimum is exactly zero if the input is exactly periodic and the frequency ($f_s$/d) denotes the pitch of the signal. The algorithm is phase insensitive as the harmonics are removed without regard to their phase.

Component Frequency Ratios

An advantage of operating in the frequency domain in contrast to other domains is that the accuracy of the pitch estimate can be improved by interpolation techniques. Due to the Short Time Fourier Transformation principles used, the frequency resolution at the higher end of the spectrum is greater than at the lower end of the spectrum. Also, the fundamental might have a weak amplitude and hence it is usually computed as ratios of harmonic frequencies or the difference between adjacent spectral peaks caused by higher harmonics.

In cases where the fundamental is absent, it is sufficient to measure the distance between the adjacent or even non-adjacent peaks of the spectrum, representing the higher harmonics of the periodic or quasi-periodic signal. The ratios of the higher frequency harmonics are more accurate as the frequency resolution improves at higher frequencies. The greatest common factor is the pitch of the speech signal.

Time Domain Techniques

Autocorrelation techniques are susceptible to frequency overlap problems, also referred to as pitch halving or pitch doubling. Also, an autocorrelation has to be computed over a wide range of lags to determine the optimum pitch. Though a rough idea of the pitch can be obtained from the number of zero-crossings, the number of operations required for accurate pitch detection can be computationally intensive.

The AMDF algorithm is susceptible to intensity variations, noise and low frequency spurious signals, which directly affect the magnitude of the principal minimum at $T_0$.

Frequency Domain Techniques

Since it is impractical to handle large segments of the input signal, the discrete version of the Short Time Fourier Transform (STFT), as proposed by Portnoff (M. R. Portnoff, "Implementation of the Digital Phase Vocoder Using the Fast Fourier Transform", IEEE Transactions on Acoustics, Speech and Signal Processing, vol. ASSP-24, pp. 243-248, June 1969), can be used in the signal analysis. Short time segments of the signal are "windowed" according to Fourier's theorem, which states that, any periodic waveform can be modeled as a sum of sinusoids with varying amplitudes and frequencies.

A fundamental problem, which arises due to the STFT, is "smearing" of the frequency response, which is illustrated in FIG. 1*a-d* (prior art). If the signal frequency coincides with one of the "bin" frequencies of the STFT, the original amplitude is retained after the STFT. However, if the signal frequency lies in between two adjacent bin frequencies of the STFT, the energy is spread over the entire spectrum, as is comparatively illustrated in FIGS. 1(*a*) and 1(*b*), where the y-axis presents signal amplitude in a logarithmic scale. Also, in the later case, as the peak frequency lies between two adjacent frequency bins, the amplitude detected is less. This is comparatively illustrated in FIGS. 1(*c*) and 1(*d*), which plot the amplitude spectrum in a linear scale. If the amplitude of the pitch frequency is too small, it might not be quantified as a potential candidate. Hence, it is critical to determine the true frequency of the signal.

This identifies a need for pitch detection of speech signals which overcomes or at least ameliorates the problems inherent in the prior art.

BRIEF SUMMARY OF THE INVENTION

By taking into account harmonic relationships within the signal spectrum while calculating the pitch, the present invention is able to eliminate the pitch halving and pitch doubling problems faced by standard time domain algorithms.

To resolve the issue of estimating peak frequencies inaccurately due to frequency "smearing", the exact frequency of a peak is determined by using phase interpolation techniques. The harmonic relationship of the signal and a pitch-tracking algorithm are used to improve the reliability of the pitch estimate.

According to a broad form of the present invention there is provided a system for determining the pitch of speech from a speech signal, the system including:

(1) an input device to receive the speech and generate the speech signal; and, (2) a processor, the processor adapted to:

(a) distinguish the speech signal into voiced, unvoiced or silence sections using speech signal energy levels;

(b) apply a Fourier Transform to the voiced speech signal and obtain speech signal parameters;

(c) determine peaks of the Fourier transformed speech signal;

(d) track the speech signal parameters of the determined peaks to select partials; and, (e) determine the pitch from the selected partials using a two-way mismatch error calculation.

According to particular features of an embodiment of the invention, the speech signal is a coded, compressed or real-time audio or data signal, and the system is adapted to perform real-time processing of live speech signals.

According to another broad form of the present invention there is provided a method of determining the pitch of speech from a speech signal, the method including the steps of:

(1) producing or obtaining the speech signal;

(2) distinguishing the speech signal into voiced, unvoiced or silence sections using speech signal energy levels;

(3) applying a Fourier Transform to the voiced speech signal and obtaining speech signal parameters;

(4) determining peaks of the Fourier transformed speech signal;

(5) tracking the speech signal parameters of the determined peaks to select partials; and, (6) determining the pitch from the selected partials using a two-way mismatch error calculation.

Preferably, but not necessarily, prior to applying the Fourier Transform a windowing procedure is applied to the speech signal. Also preferably, the windowing procedure utilizes a Blackman window, a Kaiser window, a Raised Cosine window or other sinusoidal models.

In a particular embodiment, the Fourier Transform incorporates a frame size. Preferably, the frames are overlapping. In a further particular embodiment, the signal parameters form trajectories that are tracked over a selected number of frames. Preferably, trajectories persisting over more than one frame are utilized.

Also preferably, the signal parameters are frequency, phase and amplitude. In a further particular embodiment, a zero padding procedure is used in determining the peaks of the Fourier transformed speech signal. In still a further particular embodiment, a determined peak falling within a specified frequency range of a harmonic of the pitch is set to the frequency of the harmonic.

Preferably, the two-way mismatch error calculation compares each measured partial to the nearest predicted harmonic and each predicted harmonic to the nearest measured partial to provide a total error.

According to yet another broad form of the present invention there is provided a system for estimating the pitch of speech from a speech signal, the system including:

(1) an input device to receive the speech and produce the speech signal;

(2) a memory unit or storage unit adapted to communicate required data to a processing unit;

(3) the processing unit operating on the speech signal and adapted to:

(a) section the speech signal into voiced, unvoiced or silence sections using speech signal energy levels;

(b) apply a Fast Fourier Transform to the voiced speech signal and generate speech signal parameters;

(c) calculate peaks of the Fourier transformed speech signal;

(d) track the speech signal parameters of the determined peaks to select partials; and, (e) calculate the pitch from the selected partials using a two-way mismatch error calculation.

According to the invention, frequency domain approaches for pitch detection of speech signals are preferred, as they have been found to provide better results. According to other possible aspects of the invention, an energy estimator can be utilized to help detect the voiced and silence sections of the speech signal. The frequency domain parameters can be obtained from a sinusoidal model by windowing overlapping segments of the signal and taking a Fast Fourier Transform (FFT). However, other waveform or function models can be utilized in the windowing procedure. The accurate determination of the peaks in the frequency spectrum is important. The harmonic relationship of the signal is considered in the pitch estimate by considering peaks falling within a specified range of a harmonic.

A further possible aspect of the invention, which can improve performance, is a pitch-tracking block, which can assist to obtain accurate estimates of the pitch of the signal based on previous frames. A pitch-tracking method/algorithm can be used to estimate the pitch of successive frames.

BRIEF DESCRIPTION OF THE DRAWINGS

The present invention should become apparent from the following description, which is given by way of example only, of a preferred but non-limiting embodiment thereof, described in connection with the accompanying figures.

DETAILED DESCRIPTION OF THE INVENTION

Figure 1:
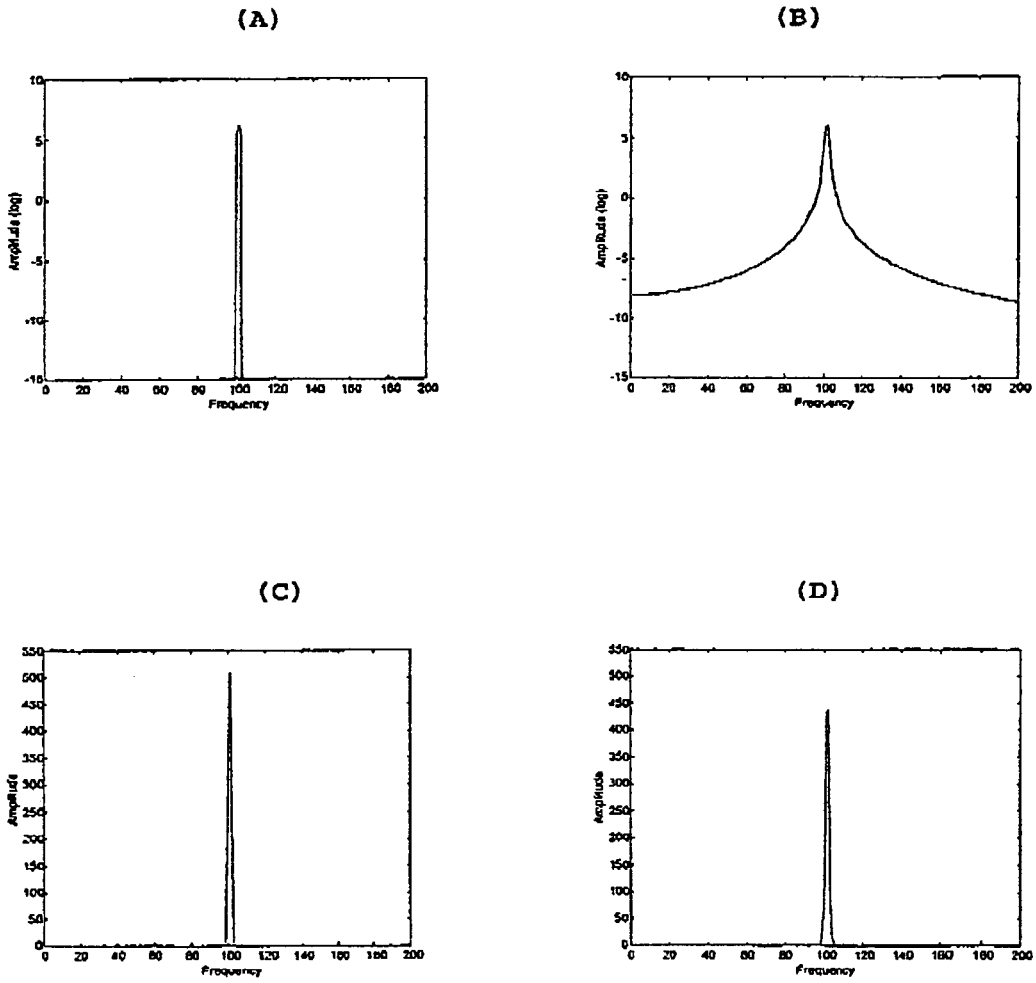
FIGURE 1 (prior art)
FIGS. 1*a* and 1*b* (prior art) illustrate example logarithmic amplitude responses of: (a) a sinusoid at the bin frequency, and, (b) a sinusoid between adjacent bins showing spreading.
FIGS. 1*c* and 1*d* (prior art) illustrate example linear amplitude responses of: (a) a sinusoid at the bin frequency, and, (b) a sinusoid between adjacent bins showing spreading.

The following modes are described as applied to the description and claims in order to provide a more precise understanding of the subject matter of the present invention.

Preferred Embodiment

In the figures, incorporated to illustrate the features of the present invention, like reference numerals are used to identify like parts throughout the figures.

A sinusoidal model (see T. F. Quatieri and R. J. McAulay, "Speech transformations based on a sinusoidal representation", IEEE Transactions on Acoustics, Speech and Signal Processing, December 1986, vol. 34, no. 6, pg. 1449) is utilized, in which the speech signal x(n), can be represented as the sum of sinusoids of varying amplitudes ($A^l_k$) and frequency peaks (m). ($L_k$=Signal Bandwidth/Pitch) is the maximum number of frequencies in the frame. That is, $$x(n) = \sum_{m=1}^{L_k} A_k^l(n) \cdot \cos(\theta_k^l(n)) \tag{3}$$

If $\phi^l_k$ is the starting phase of the of the $k^{th}$ sinusoid in the $l^{th}$ frame, $\theta^l_k(n)$ is defined in Equation 4, $$\theta_k^l(n) = \frac{2 \cdot \pi \cdot k \cdot n}{N} + \phi_k^l \tag{4}$$

Figure 2:
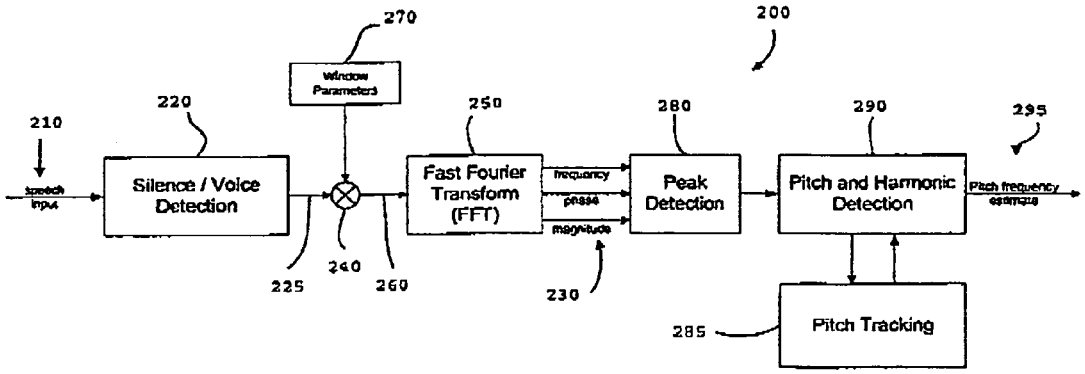
FIG. 2 illustrates a method for the pitch detection of speech signals using frequency domain techniques.

This allows calculation of the frequency domain parameters of the signal and use of the phase information to determine the true frequency components present in the signal. The flowchart of a preferred method 200 (that can equally be interpreted as a block diagram of system components) according to the present invention is illustrated in FIG. 2.

Parameter Estimation.

As speech signals 210 consist of silenced and voiced sections, to avoid erroneous pitch detection, these segments of the input 210 are differentiated 220 at the start of the parameter estimation phase of the algorithm using varying energy levels in the signal 210.

The frequency domain parameters 230 are obtained by windowing 240 a short time segment of the signal 225 and taking its Fourier Transform 250, as described in Equation 5.

$$X(t_a^l, \Omega_k) = \sum_{n=-\infty}^{\infty} h(n) \cdot x(t_a^l + n) e^{-j \cdot \Omega_k \cdot n} \tag{5}$$

At uniform analysis time instants $t^l_a = l \cdot R_a$ where $R_a$ is the analysis hop factor and l is the frame number, the Fourier Transform 250 of the windowed signal 260 is calculated. If N is the size of the Fast Fourier Transform (FFT) 250, $\Omega_k = 2 \cdot \pi \cdot k/N$ is the center frequency of the $k^{th}$ bin.

The analysis window h(n) is critical for reducing frequency smearing and the window size 270 controls the frequency resolution. "Zero padding" of the frequency spectrum (see J. O. Smith, "Mathematics of the Discrete Fourier Transform (DFT)", Center for Computer Research in Music and Acoustics (CCRMA), Stanford University) is used to obtain an ideally interpolated spectrum, which is used for a better estimate of the peaks in the frequency spectrum at step 280.

Pitch Estimation

Weighted lists of active frequencies within each analysis window are generated, and using basic pattern-matching procedures contiguous frequency tracks are obtained. The track frequency with the maximum number of harmonics is computed using a two-way mismatch procedure 290 and determined to be the pitch 295 of the signal 210. Reliability of the pitch frequency estimate 295 is ensured by using pitch tracking algorithms 285, which minimize the error of prediction based on estimates in the previous frames.

A. Standard Block Level Implementation

Step A1. Input Format (210)

The aforementioned process can be readily implemented as system architecture and can handle Pulse Code Modulated (PCM) signals as input, which is a standard format of coded audio signals. The input is of CD quality, i.e., it is sampled at a rate of 44,100 samples/second. For real-time processing, the signal is processed 2048 samples in a frame, which is approximately 46 milliseconds at the given sampling rate. However to maintain a 50% overlap, only 1024 samples are read in during each frame and the remaining 1024 samples are used from the previous frame.

Step A2. Silence/Voice Detection (220)

Speech signals are usually considered as voiced or unvoiced, but in some cases they are something between these two. Voiced sounds consist of fundamental frequency ($f_0$) and harmonic components produced by the human vocal cords. Purely unvoiced sounds have no fundamental frequency in the excitation signal and therefore harmonic structures are absent in the signal.

The short-term energy is higher for voiced than unvoiced speech, and should also be zero for silent regions in speech. Short-term energy allows one to calculate the amount of energy in a signal at a specific instant in time, and is defined in Equation 6.

$$E_a^l = \sum_{n=(l-1)\cdot N+1}^{l \cdot N} x(n)^2 \tag{6}$$

The energy in the $l^{th}$ analysis frame of size N is $E^l_a$. Depending upon the classification of the speech sample into voiced/unvoiced or silenced sections, the following pitch detection algorithm is activated. The pitch detection algorithm is preferably activated only if there is a voiced section in the signal. During noise or silence—neither has any pitch—the pitch detection algorithm is preferably not activated.

Step A3. Window Parameters (270)

The choice of the analysis window is a trade-off of time and frequency resolution, which affects the smoothness of the spectrum and the detection of frequency peaks. Perfect reconstruction is not a criteria for the window shape as the algorithm is used only for pitch estimation and not for signal reconstruction. Hence, the algorithm implements windowing schemes, which provide better frequency resolution. The Blackman window (see http://www-ccrma.stanford.edu/~jos/Windows/Blackman_Harris_Window_Family.html) has a worst-case side-lobe rejection of 58 dB down, which is good for audio applications. However, the Kaiser window (see J. O. Smith, "The window method for digital filter design", Winter 1992, *Mathematica notebook for Music* 420 (EE367A), ftp://ccrma-ftp.stanford.edu/pub/DSP/Tutorials/Kaiser.ma.Z) allows control of the main-lobe width and the highest side-lobe level. If one desires less main-lobe width, then a higher side-lobe level is produced, and vice versa.

The windows also serve a dual purpose of reducing spectral leakage or "smearing" by tapering the data record gradually to zero at both end-points of the window. As a result of the smooth tapering, the main lobe of the frequency response widens and the side-lobe levels decrease.

Figure 3:
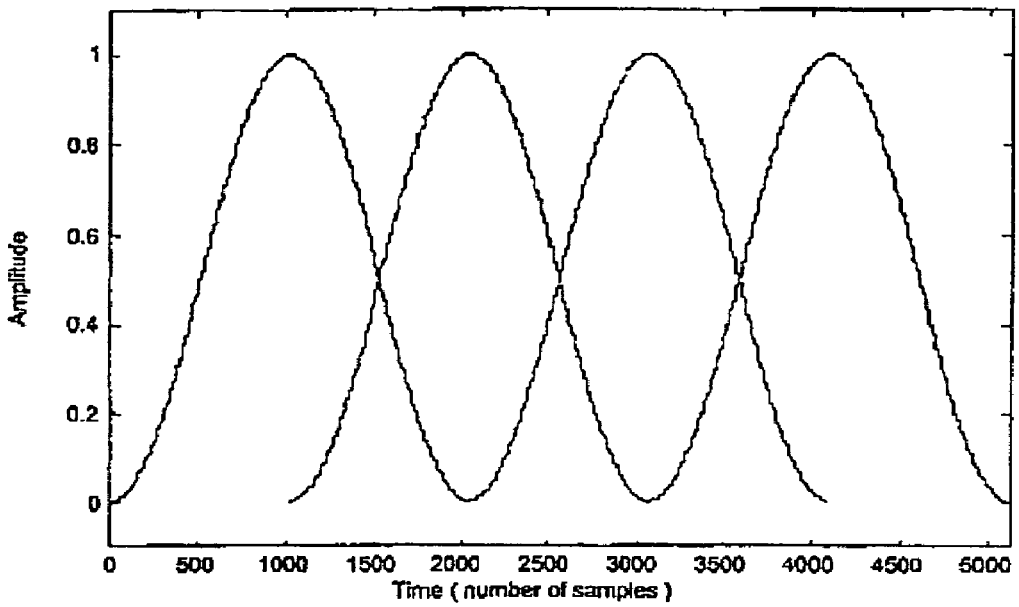
FIG. 3 illustrates a 50% overlap added in a raised cosine window.

Using no window is akin to using a rectangular window, unless the signal is exactly periodic in samples. It should be noted that increasing the number of samples in a frame does not reduce spectral leakage. The Raised Cosine window is given by h(n):

$$h(n) = \frac{1}{2} - \frac{1}{2} * \cos\left(\frac{2 * \pi * n}{N}\right) \tag{7}$$

where, N is the same as the frame size in this case and n varies from zero to (N−1). A series of overlap added raised cosine windows are shown in FIG. 3. A detailed discussion on the effect of windows in peak detection follows hereinafter. Overlapping frames ensure that the pitch estimate is updated on a regular basis.

Step A4. Fast Fourier Transform (250)

The N point FFT of the windowed signal returns the amplitude, starting phases and the frequencies of the signal within the frame. For computational efficiency, N is selected as a power of two, though this is not necessarily required. The frame size, as well as the window size are given by N. The FFT can also be interpreted as a Linear Time Invariant filterbank followed by an exponential modulator, which allows one to extract the parameters 230 of the signal 210. The frequency and its corresponding amplitude and phase parameters form trajectories.

Step A5. Peak Detection (280)

To determine the pitch of the input signal 210, peaks are detected in the amplitude spectrum. Preferably, though not necessarily, the peaks are chosen based on their relative magnitude difference between neighboring frequency bins. An 80 dB cut-off criterion is applied to limit the number of peaks. Logarithmic plots can be used for the peak frequency determination, as they are smoother than the amplitude spectrum plots. In one embodiment, the transform of the amplitude spectrum is zero padded and the Inverse Fourier transform is computed to increase the frequency resolution and smooth the spectrum. This step can be discarded if computational efficiency is desired.

Step A6. Harmonic Detection (290)

Pitch is the fundamental frequency of vibration of the source of the tone. In simple mathematical terms, it is the least common divisor of the peak frequencies of the signal if it is harmonic in nature. Speech signals are harmonic in nature and hence, it is easier to determine the signal harmonics using the pitch information.

As discussed in S. S. Abeysekera, K. P. Padhi, J. Absar and S. George, "Investigation of different frequency estimation techniques using the phase vocoder", International Symposium on Circuits and Systems, May 2001, the true frequency associated with the $k^{th}$ bin is calculated from the Fourier Transform X(l, k) as defined in Equation 4, over two consecutive frames that are separated by H samples, i.e., $$\hat{f} = \frac{k}{N} + \frac{\mathrm{Arg}\{X(1,k)\} - \mathrm{Arg}\{X(0,k)\}}{2 \cdot \pi \cdot H} \tag{8}$$

Accurate peak determination is essential to determine the exact pitch of the input signal 210. Besides detecting the pitch, this block is also responsible for detecting the harmonics present in the signal. Once the peak frequencies and the pitch are detected in the signal, any peak falling within a specified range of a harmonic is forced to the frequency of the harmonic. In other words, if $$|f - m \cdot f_0| \leqq \delta \tag{9}$$

where, $f$ is the peak frequency, $f_0$ is the fundamental pitch frequency, m is any integer and δ is an arbitrary constant which determines how close a frequency should be before it is forced to the nearest harmonic frequency. The constant δ is constrained by the accuracy of the parameter estimation system. The higher the accuracy, the smaller the value of δ; the coarser the parameter estimation algorithm, the larger the value of δ.

Step A7. Pitch Tracking (285)

The frequency, amplitude and phase parameters 230 of the peak frequencies form trajectories, which are tracked across the frames. To avoid detecting spurious peak frequencies, only those trajectories lasting over a number of frames are chosen for harmonic matching.

Figure 4:
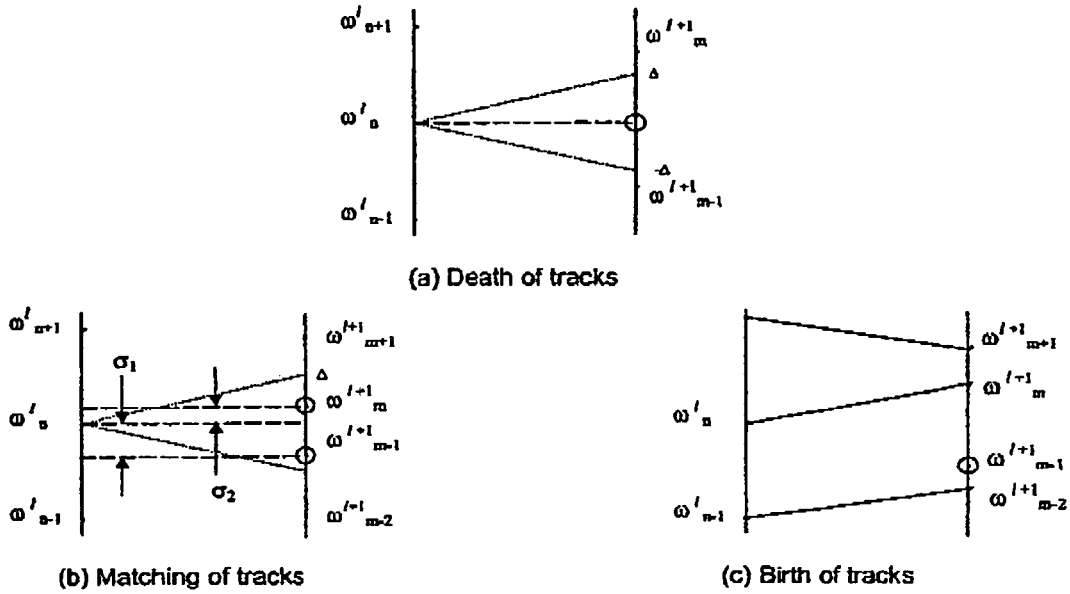
FIGS. 4*a*, 4*b*, and 4*c* illustrate trajectory continuations for: (a) death of tracks; (b) matching of tracks; and (c) birth of tracks.

The tracking procedure consists of piecing together the parameters that fall within certain minimum frequency deviations and choosing trajectories that minimize frequency distance between the parameters. Assuming, all the previous peak frequencies up to bin k in frame l have been matched, and $\omega^l_k$, $A^l_k$ represent the frequency and amplitude parameters of bin k in frame 1. The concept of death, continuation and birth of tracks is illustrated in FIGS. 4(*a*), (*b*) and (*c*), respectively.

- if $|\omega^l_k - \omega^{l+1}_q| \geqq \Delta \Rightarrow$ the track dies $\Rightarrow A^{l+1}_k = 0$.
- if $|\omega^l_k - \omega^{l+1}_q| < \Delta \Rightarrow \omega^{l+1}_k$ is a "tentative" match, i.e., there might be other matching frequencies in the vicinity and hence one should check the entire frequency range.
- if $|\omega^l_k - \omega^{l+1}_q| < |\omega^l_k - \omega^{l+1}_{i+1}| \Rightarrow$ if frequency $\omega^{l+1}_q$ is not matched to any other frequency and is the closest to $\omega^l_k$, $\omega^{l+1}_q$ is a "perfect" match.
- All unmatched peak frequencies in frame l+1, are designated as new tracks born $\Rightarrow A^{l-1}_k = 0$.

A minimum sleeping time concept ensures that long duration tracks are "killed" only if they do not recur within a specified time.

Step A8. Pitch Determination (290)

The peaks in the amplitude spectrum are herein referred to as "partials" for clarity.

The most likely fundamental frequencies can be chosen from the peaks in the spectrum based on the greatest common divisor of maximum number of partials in the signal spectrum. The initial pitch search could be localized to a frequency range of 110-130 Hz and 200-230 Hz, for male and female speech signals respectively, although other ranges could be selected.

The two-way mismatch error calculation is a two step process in which each measured partial is compared to the nearest predicted harmonic giving the measured-to-predicted error $Err_{p\to m}$, and each predicted harmonic is compared to the nearest measured partial giving the predicted-to-measured error $Err_{m\to p}$. The total error $Err_{total}$ is a weighted combination of these two errors.

The error is normalized by the fundamental frequency and also incorporates factors, which take into account the effect of amplitudes of the partials, i.e., the Signal to Noise Ratio (SNR) on the pitch of the signal.

$$\begin{aligned} Err_{total} &= \frac{Err_{p\to m}}{N} + \rho\cdot\frac{Err_{m\to p}}{K} \\ &= \frac{1}{N}\sum_{n=1}^{N}\left[\frac{\Delta f_n}{f_n^p} + \frac{a_n}{A_{max}}\cdot\left\{q\cdot\frac{\Delta f_n}{f_n^p} - r\right\}\right] + \\ &\quad \rho\cdot\frac{1}{K}\sum_{k=1}^{K}\left[\frac{\Delta f_k}{f_k^p} + \frac{a_k}{A_{max}}\cdot\left\{q\cdot\frac{\Delta f_k}{f_k^p} - r\right\}\right] \end{aligned} \tag{10}$$

where, N is the number of harmonics of the trial fundamental frequency ($f_{fund}$) given by $N=\lfloor f_{max}/f_{fund}\rfloor$. The $\lfloor x\rfloor$ operation returns the smallest integer greater than x, $f_{max}$ is the highest frequency and $A_{max}$ is the maximum amplitude of the measured partials. K is the total number of partials, i.e., critical frequencies in each frame.

As the error is a function of the frequency difference ($\Delta f_n=\Delta f_k=|f_n-f_k|$) between the nearest harmonic frequency $f_n$ and the measured peak in the spectrums $f_k$, maximum error occurs when there are missing harmonics or when the ratio of the amplitudes is small. Similarly, minimum error will occur when most of the harmonics of the trial frequency are present and the ratio of the amplitudes is large. Maher et al. (see R. C. Maher and J. W. Beauchamp, "Fundamental frequency estimation of musical signals using a two-way mismatch procedure", Journal of the Acoustical Society of America, Apr. 1994, vol. 95(4), pg. 2254) have determined that p=0.5, q=1.4 and r=0.5 satisfy the above weighting properties. The frequency which produces a minimum mismatch error is the pitch of the signal.

B. Improvements in the Pitch Detection Algorithm

The human hearing system (the ears and the related perception system in the brain) is more sensitive to frequencies in the range of 1000 Hz-3000 Hz. However, speech signals have a bandwidth of 20 Hz-8 kHZ. The pitch search can be localized within a range of 50 Hz-500 Hz, as beyond these frequencies mostly harmonics will be present. However, the peak detection algorithm is used over the entire speech spectrum to capture as many harmonic frequencies as possible. Larger numbers of frequencies chosen lead to an accurate determination of the pitch. In this section, enhancements in the developed pitch detection method/system are discussed.

B1. Effect of Windowing

By considering a sinusoidal model, the spectrum of the window is shifted by the frequency of the sinusoids. The amplitude of the bins adjacent to the peak frequencies is determined by the side-lobe levels of the raised cosine spectrum of the window, as obtained in Equation 11.

$$\begin{aligned} W(k) &= \sum_{n=0}^{N-1} w(n)\cdot e^{\frac{-j\cdot 2\cdot\pi k\cdot n}{N}} \\ &= \sum_{n=0}^{N-1}\left\{\frac{1}{2}+\frac{1}{2}\cdot\cos\left(\frac{2*\pi*n}{N}\right)\right\}\cdot e^{\frac{-j\cdot 2\cdot\pi\cdot k\cdot n}{N}} \\ &= \sum_{n=0}^{N-1}\left\{\frac{1}{2}+\frac{1}{2}\cdot\left(e^{\frac{j\cdot 2\cdot\pi\cdot n}{N}}+e^{\frac{-j\cdot 2\cdot\pi\cdot n}{N}}\right)\right\}\cdot e^{\frac{-j\cdot 2\cdot\pi\cdot k\cdot n}{N}} \\ &= \frac{N}{4}\cdot e^{\frac{-j\cdot\pi\cdot k\cdot(N-1)}{N}}\left[2\cdot\frac{\mathrm{Sinc}(k)}{\mathrm{Sinc}(k/N)}+\frac{\mathrm{Sinc}(k-1)}{\mathrm{Sinc}((k-1)/N)}\cdot\right. \\ &\quad \left. e^{j\pi\left(1-\frac{1}{N}\right)}+\frac{\mathrm{Sinc}(k+1)}{\mathrm{Sinc}((k+1)/N)}\cdot e^{-j\pi\left(1+\frac{1}{N}\right)}\right] \end{aligned} \tag{11}$$

Figure 5:
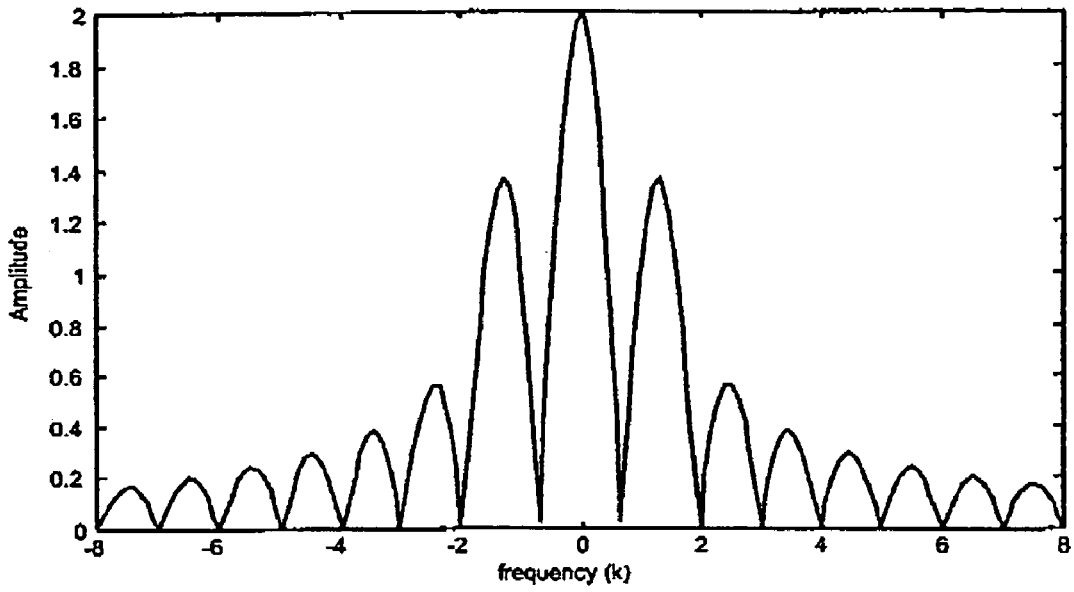
FIG. 5 illustrates the spectrum of the raised cosine window.
Figure 6:
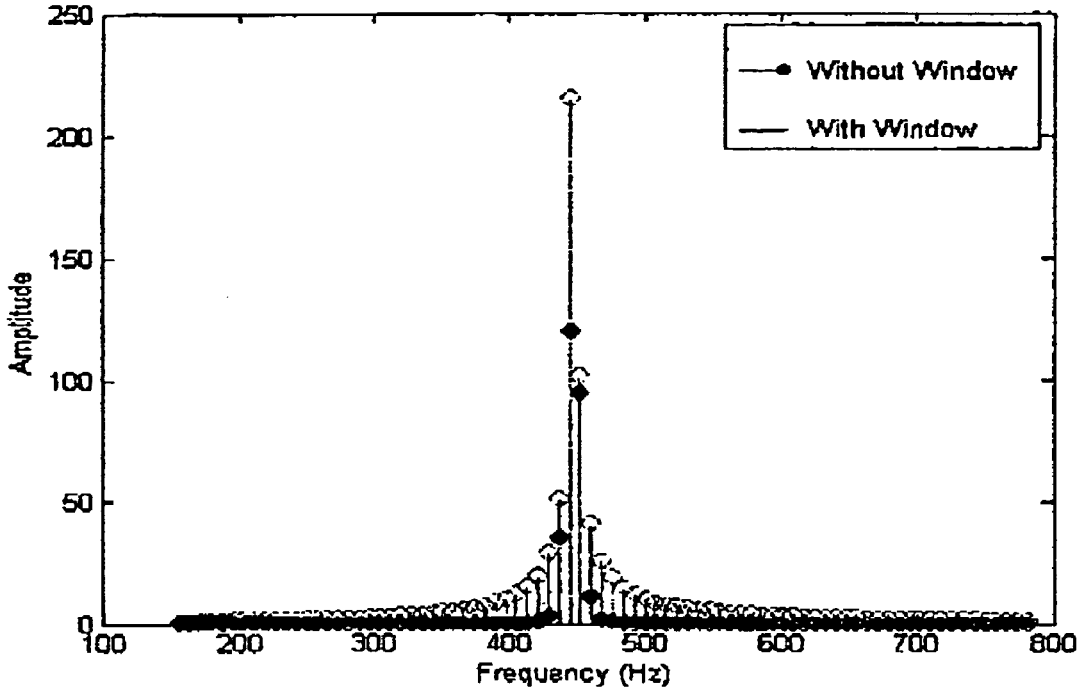
FIG. 6 illustrates the effect of windowing the signal of the spectrum.

As can be seen from the FIG. 5, W(0)=2, W(±1)=1, W(k)=0: ∀ all other values of k. The worst case spreading of the sinusoid spectrum occurs when the true frequency lies exactly between two frequency bins. Though the side-lobes enhance undesirable frequency components, they enhance the peak frequency components in the spectrum as shown in FIG. 6.

A complex sinusoid of the form $x(n)=A\cdot e^{j\cdot k_x nT}$, when windowed, transforms to, $$\begin{aligned} X_x(k) &= \sum_{n=-\infty}^{\infty} x(n)\cdot h(n)\cdot e^{-j\cdot knT} = \\ &\quad A\sum_{n=-(M-1)/2}^{(M-1)/2} h(n)\cdot e^{-j\cdot(k-k_x)nT} = A\cdot W(k-k_x) \end{aligned} \tag{12}$$

where W(k) is defined in Equation 11. Thus, the transform of a windowed sinusoid, isolated or part of a complex tone, is the transform of the window scaled by the amplitude of the sinusoid and centered at the sinusoid's frequency.

B2. Effect of Frequency Padding

Figure 7:
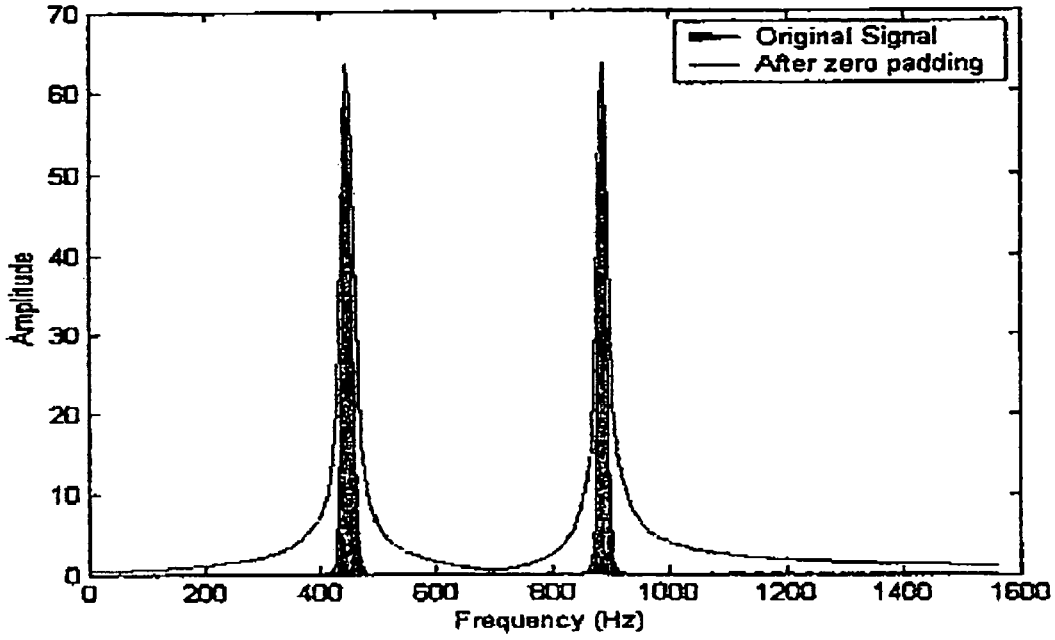
FIG. 7 illustrates the effect of zero padding the spectrum.

The dual of the Zero Padding theorem (J. O. Smith, "Mathematics of the Discrete Fourier Transform (DFT)", Center for Computer Research in Music and Acoustics (CCRMA), Stanford University) states that zero padding in the frequency domain corresponds to ideal bandlimited interpolation in the time domain. As can be seen in FIG. 7, the interpolated spectrum obtained after computing the inverse transform of the zero padded Fourier spectrum is much smoother than the original spectrum. This further enhances the true peaks in the spectrum.

This further signal processing coupled with an accurate determination of the true frequency of the speech ensures a superior pitch detection algorithm.

B3. Enhanced Pitch Detection

The two-way mismatch algorithm for pitch detection solves the pitch halving and pitch doubling problems faced by traditional time domain algorithms. For each trial fundamental frequency, the two-way mismatch error is computed and the frequency with the minimum error is set to be the pitch of the signal.

In the present method/system, $\Delta f_n$ is defined as follows, $$\Delta f_n = |f_n - f_k|; \text{ if } f_k \text{ within } \pm f_{fund}/2 \text{ Hz of } f_n$$
$$= |f_n|; \quad \text{if } f_k \text{ is not within } \pm f_{fund}/2 \text{ Hz of } f_n$$

The same criteria is also used for calculating $\Delta f_k$. This ensures that the error is higher for missing harmonics beyond the search range while putting a limit on the search criteria. This enhances the pitch detection algorithm for speech signals, which are very harmonic in nature.

The Applicants considered a test signal containing the series of partials {100, 200, 300, 500, 600, 700, 800} Hz. For a trial fundamental frequency $f_{fund}$=50 Hz, all the partials are harmonics, however, the harmonics at {50, 150, 250, 350, 400, 450, 550} Hz are missing. Similarly, $f_{fund}$=100 Hz, only the harmonic at {400} Hz is missing.

Figure 8:
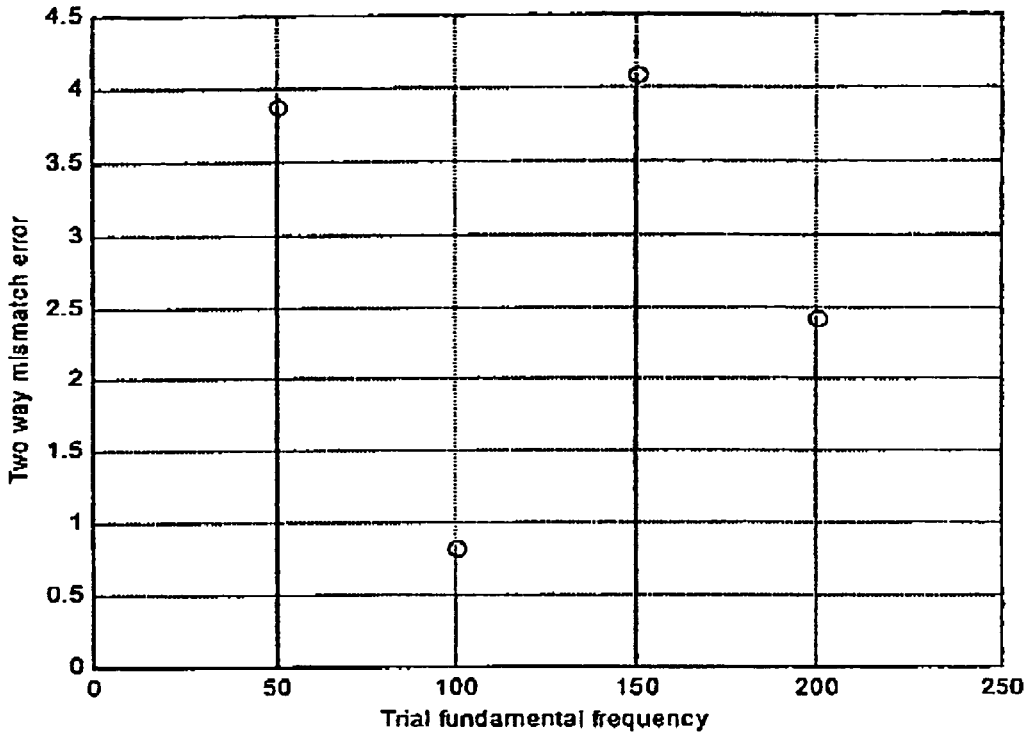
FIG. 8 illustrates the mismatch error for different fundamental frequencies.

FIG. 8 plots the mismatch error based on Equation 10. As the mismatch error is minimum for a trial fundamental frequency of 100 Hz, it is the fundamental frequency of the given set of partials.

The different blocks in the architecture ensure that the method algorithm detects the pitch accurately across successive frames.

C. Simulation Results

This section demonstrates the use of frequency domain techniques to determine the pitch of speech audio signals. Both artificially synthesized and natural speech signals are tested. It is essential to use synthesized signals to test the algorithm as there is no standard benchmark to compare the pitch of the signal. Since the signal is synthesized, the pitch of the signal is known and hence a direct comparison is possible.

C1. Sinusoids

Figure 9:
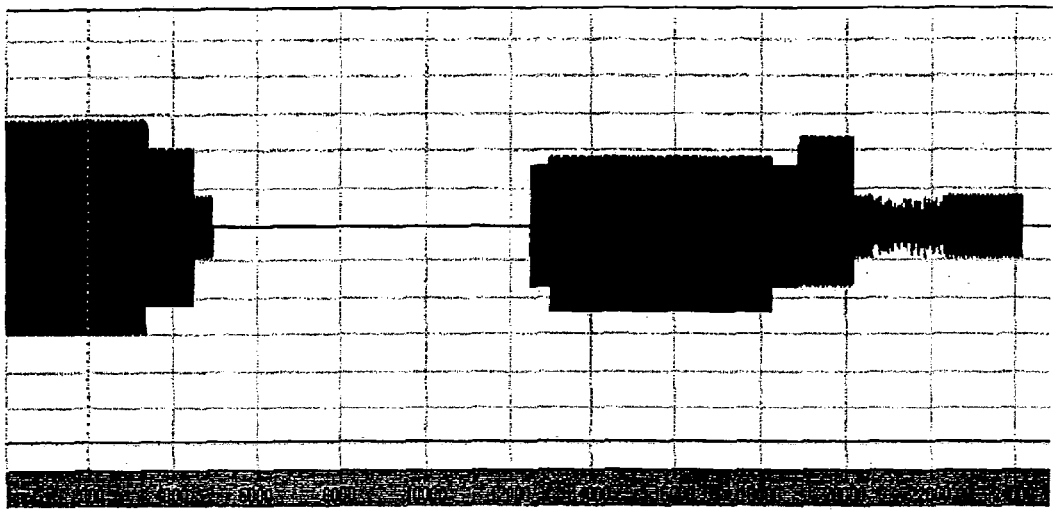
FIGS. 9*a* and 9*b* illustrate (a) amplitude modulated input with multiple sinusoids (in the time domain), and (b) input with multiple sinusoids (in the frequency domain)
Figure 9:
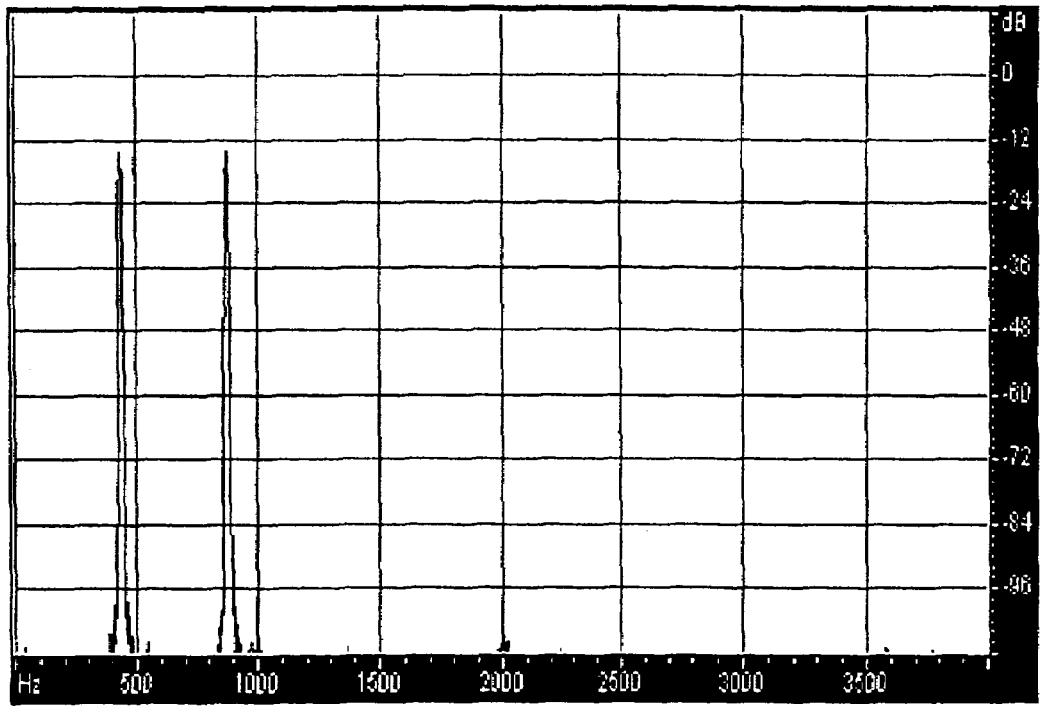

As speech signals are represented by a sinusoidal model, the algorithm is first tested on a purely sinusoidal input. The input consists of constant equal amplitude sinusoids at harmonically related frequencies of 440 Hz, and 880 Hz. The input sampling frequency is 8 kHz, the frame size is 2048 samples with a 50% overlap of 1024 samples. The signal is generated over multiple frames and the amplitude is modulated and mixed with noise as presented in FIGS. 9(*a*) and 9(*b*).

Figure 10:
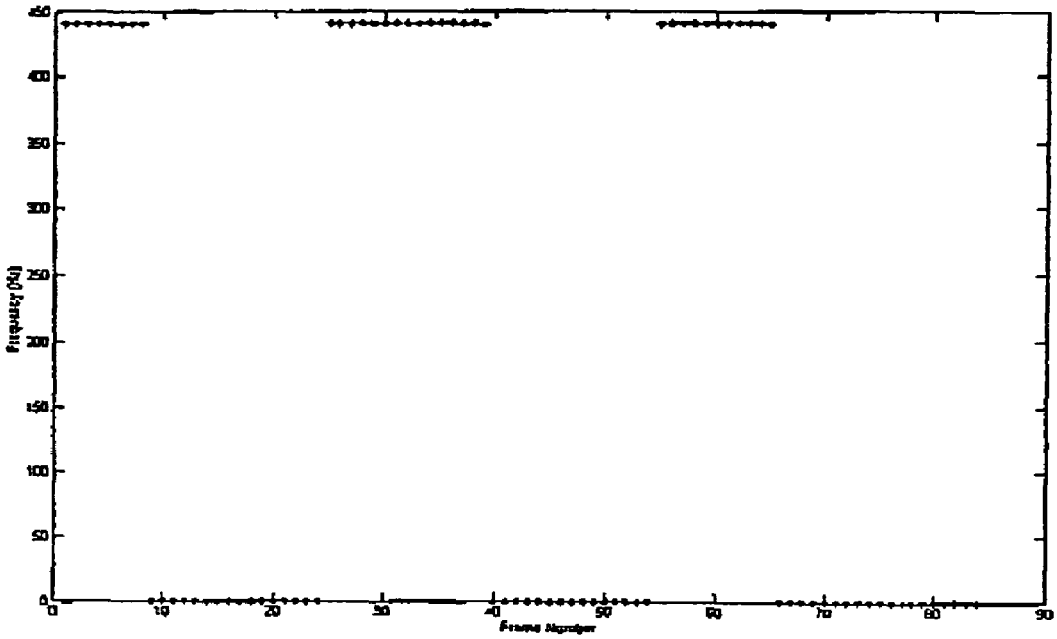
FIG. 10 illustrates pitch estimates of multiple sinusoids.

The time-pitch frequency plot of the signal is presented in FIG. 10. The x-axis denotes the time in terms of the number of frames. The y-axis shows the pitch frequency in the STFT, which satisfies the peak detection criteria and the minimum mismatch error criteria as previously discussed. As can be seen from FIG. 10, the developed method is successfully able to determine the pitch of the input signal depending on whether the input is silence or noise or sinusoidal in nature.

C2. Frequency Modulated Sinusoid

Figure 11:
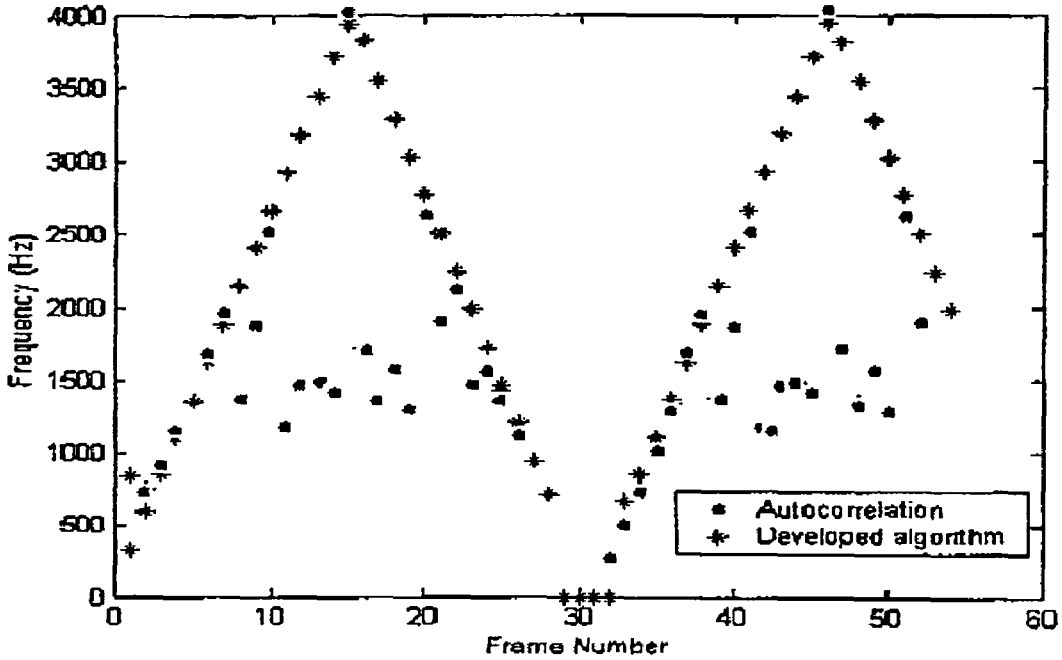
FIG. 11 illustrates pitch estimates of a frequency chirp.

To test the pitch tracking algorithm, the frequency of the input is varied from 0 Hz to 4 kHz over time. FIG. 11 shows the time-pitch frequency plot of the algorithm as compared to standard autocorrelation techniques. As can be seen, the time domain techniques suffer from pitch halving problems, whereas the present successfully tracks pitch.

C3. Speech Signals

Figure 12:
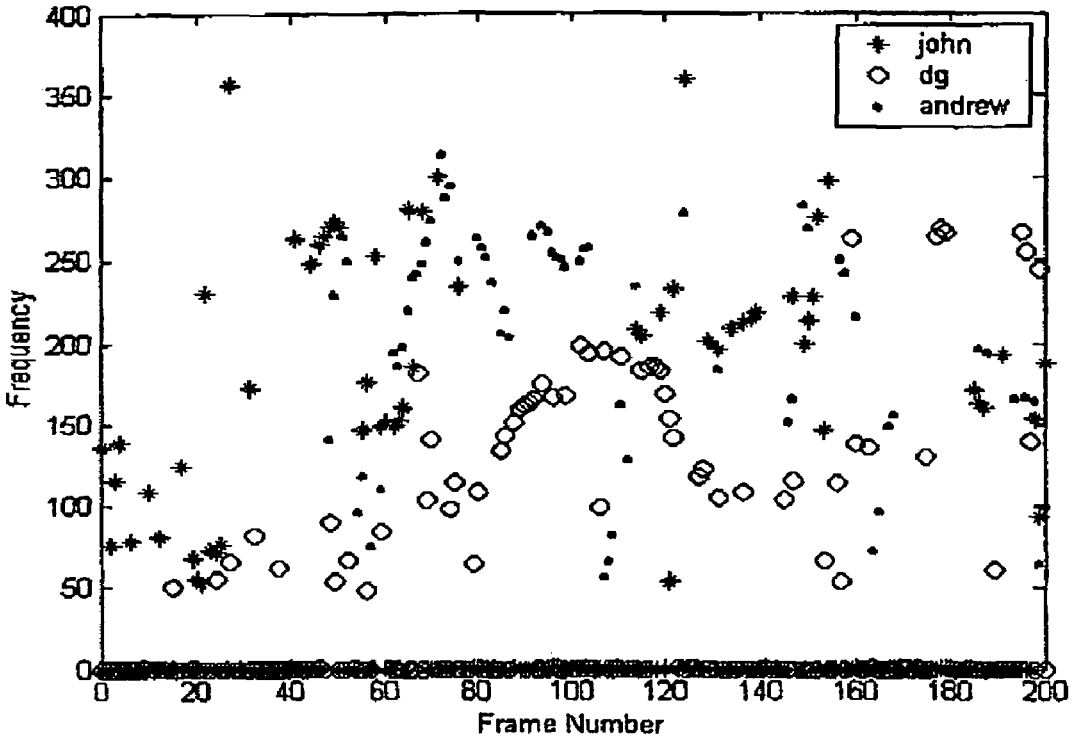
FIG. 12 illustrates pitch estimates of speech signals for three different speakers.

FIG. 12 shows the pitch characteristics of three different male speakers speaking "A tiger and a mouse were walking in a field". Both John and Andrew are British English speakers while Dg is an African speaker of English. It can be seen that Dg's voice has a much lower pitch than that of the British speakers. FIG. 12 also shows the change in the pitch of the signal according to the speaker's pronunciation as he speaks.

Various Embodiments

Figure 13:
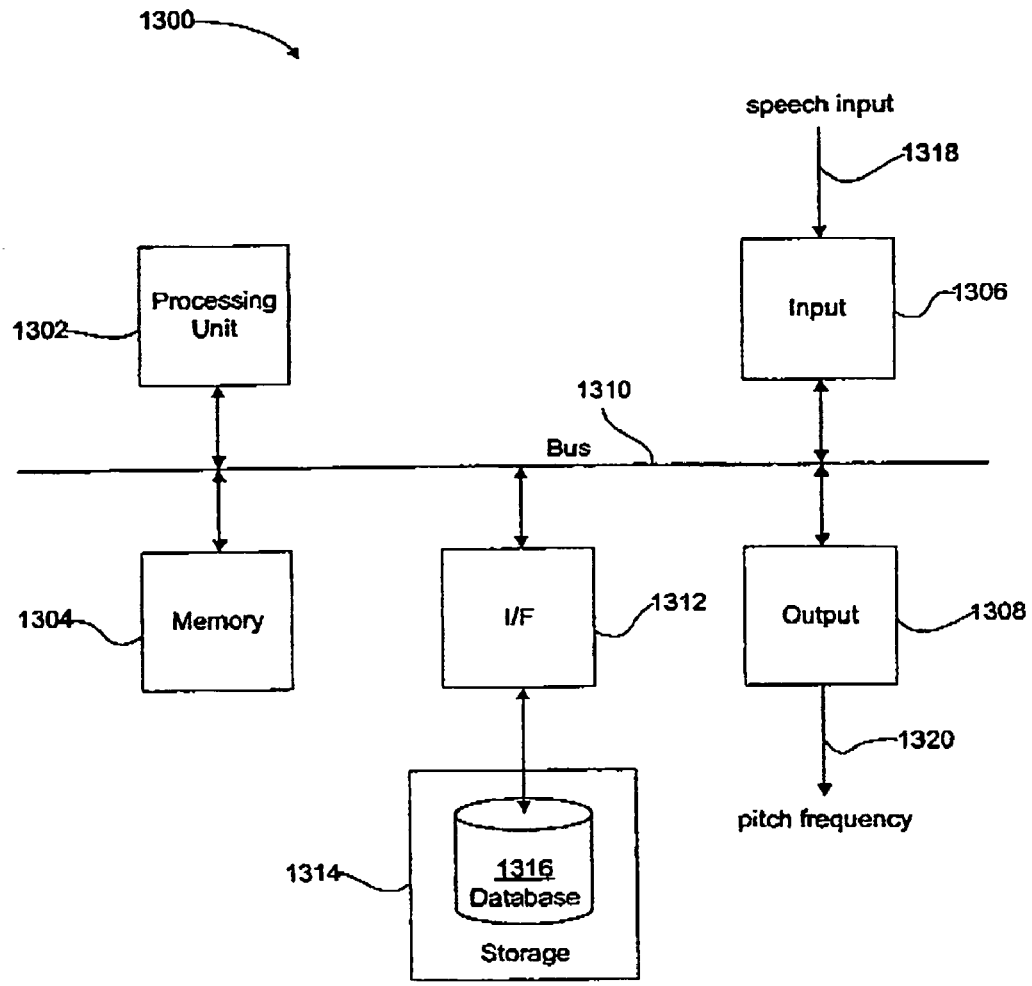
FIG. 13 illustrates a functional block diagram of a processing system embodiment of the present invention.

Other embodiments of the present invention are possible. According to another embodiment of the present invention a processing system, an example of which is shown in FIG. 13, is utilized. In particular, the processing system 1300 generally includes at least a processor or processing unit 1302, a memory 1304, an input device 1306 and an output device 1308, coupled together via a bus or collection of buses 1310. An interface 1312 can also be provided for coupling the processing system 1300 to a storage device 1314 which may house a database 1316. The memory 1304 can be any form of memory device, for example, volatile or non-volatile memory, solid state storage devices, magnetic devices, etc. The input device 1306 receives speech input 1318 and can include, for example, a microphone, a stored audio device (e.g., CD), a voice control device, data acquisition card, etc. The output device 1308 produces a pitch estimate output 1320 and could be, for example, a display device, internal component or electronic device, etc. The storage device 1314 can be any form of storage means, for example, volatile or non-volatile memory, solid state storage devices, magnetic devices, etc.

In use, the processing system 1300 is adapted to allow data or information to be stored in and/or retrieved from the storage device 1314 or database 1316 if required. Alternatively, required data or information could be retrieved from memory 1304. The processor 1302 acts upon speech input 1318 in accordance with the method of the present invention. It should be appreciated that the processing system 1300 may be a specialized electronic device or chip, processing system, computer terminal, server, specialized hardware or firmware, or the like.

The method of the present invention could readily be embodied as software, hardware, firmware or the like, or a combination thereof. Various programming languages could be utilized to realize the method.

The invention may also be said to broadly consist in the parts, elements and features referred to or indicated herein, individually or collectively, in any or all combinations of two or more of the parts, elements or features, and where specific integers are mentioned herein which have known equivalents in the art to which the invention relates, such known equivalents are deemed to be incorporated herein as if individually set forth.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

Although the preferred embodiment has been described in detail, it should be understood that various changes, substitutions, and alterations can be made herein by one of ordinary skill in the art without departing from the scope of the present invention.

The invention claimed is:

1. A system for determining a pitch of speech from a speech signal, the system including:

(1) an input device to receive the speech and generate the speech signal; and (2) a processor structured to:

(a) distinguish the speech signal into voiced, unvoiced or silenced sections using speech signal energy levels;

(b) apply a Fourier Transform to the voiced speech signal section and obtain speech signal parameters;

(c) determine peaks of the Fourier transformed voiced speech signal section;

(d) select partials by tracking the speech signal parameters of the determined peaks over a plurality of frames of the speech signal to determine trajectories; and (e) determine the pitch from the selected partials using a two-way mismatch error calculation, the two-way mismatch error calculation including:

setting a trial fundamental frequency ($f_{fund}$);

determining a plurality of predicted harmonics corresponding to the trial fundamental frequency;

for one of the plurality of predicted harmonics, determining if any of the selected partials is within ($f_{fund}/2$) of the predicted harmonic;

setting a harmonic frequency error equal to a frequency value of the predicted harmonic in response to determining that none of the selected partials is within ($f_{fund}/2$) of the predicted harmonic; and determining whether to set the pitch equal to the trial fundamental frequency based at least in part on the harmonic frequency error.

2. The system according to claim 1, wherein the speech signal is a coded, compressed or real-time audio or data signal.

3. The system according to claim 1, adapted to perform real-time processing of live speech signals.

4. The system according to claim 1, wherein the speech signal is a Pulse Code Modulated signal.

5. The system according to claim 1, wherein the system is incorporated into a karaoke system, computer system or voice recognition system.

6. The system according to claim 1, wherein the input device is a microphone or audio receiver.

7. A method of determining a pitch of speech from a speech signal, the method including the steps of:

obtaining the speech signal; that has been received at a microphone distinguishing the speech signal into voiced, unvoiced or silenced sections using speech signal energy levels; applying a Fourier Transform to the voiced speech signal section and obtaining speech signal parameters;

determining peaks of the Fourier transformed voiced speech signal section;

selecting partials by tracking the speech signal parameters of the determined peaks over a plurality of frames of the speech signal to determine trajectories; and determining the pitch from the selected partials using a two-way mismatch error calculation, the two-way mismatch error calculation including:

setting a trial fundamental frequency ($f_{fund}$);

determining a plurality of predicted harmonics corresponding to the trial fundamental frequency;

for one of the plurality of predicted harmonics, determining if any of the selected partials is within ($f_{fund}/2$) of the predicted harmonic;

setting a harmonic frequency error equal to a frequency value of the predicted harmonic in response to determining that none of the selected partials is within ($f_{fund}/2$) of the predicted harmonic; and determining whether to set the pitch equal to the trial fundamental frequency based at least in part on the harmonic frequency error.

8. The method according to claim 7, wherein prior to applying the Fourier Transform a windowing procedure is applied to the voiced speech signal section.

9. The method according to claim 8, wherein the windowing procedure utilizes a Blackman window, a Kaiser window, a Raised Cosine window or other sinusoidal models.

10. The method according to claim 7, wherein applying the Fourier Transform comprises applying the Fourier Transform to a frame of the voiced speech signal section.

11. The method according to claim 10, wherein the frame is one of a plurality of overlapping frames.

12. The method according to claim 10, wherein the signal parameters are tracked over the plurality of frames of the voiced speech signal section.

13. The method according to claim 12, wherein the trajectories persisting over more than one frame of the plurality of frames are utilized.

14. The method according to claim 7, wherein the Fourier Transform is a Fast Fourier Transform.

15. The method according to claim 7, wherein the speech signal parameters are frequency, phase and amplitude.

16. The method according to claim 7, wherein a zero padding procedure is used in determining the peaks of the Fourier transformed voiced speech signal section.

17. The method according to claim 7, wherein a frequency of a determined peak falling within a specified frequency range of a frequency of a harmonic of the pitch is set equal to the frequency of the harmonic.

18. The method according to claim 7, wherein the peaks are determined in an amplitude spectrum.

19. The method according to claim 18, wherein the peaks are determined in the amplitude spectrum using a logarithmic scale.

20. The method according to claim 7, wherein the partials are selected from the determined peaks based on a greatest common divisor of a maximum number of partials in a voiced speech signal section spectrum.

21. The method according to claim 7, wherein the two-way mismatch error calculation further includes, if a nearest of the selected partials is within ($f_{fund}/2$) of the predicted harmonic, setting the harmonic frequency error equal to an absolute value of a frequency value of the nearest selected partial subtracted from the frequency value of the predicted harmonic.

22. The method according to claim 21, wherein the two-way mismatch error calculation further includes:

for one of the selected partials, determining if any of the plurality of the predicted harmonics is within ($f_{fund}/2$) of the selected partial;

setting a partial frequency error equal to a frequency value of the selected partial in response to determining that none of the predicted harmonics is within ($f_{fund}/2$) of the selected partial; and determining whether to set the pitch equal to the trial fundamental frequency based at least in part on the partial frequency error.

23. The method according to claim 22, wherein the two-way mismatch error calculation further includes, if a nearest of the plurality of predicted harmonics is within ($f_{fund}/2$) of the selected partial, setting the partial frequency error equal to an absolute value of a frequency value of the nearest predicted harmonic subtracted from the frequency value of the selected partial.

24. The method according to claim 7, wherein the speech signal energy levels are short-term signal energy levels.

25. The method according to claim 7, wherein distinguishing the speech signal further comprises utilizing an energy estimation calculation.

26. The method according to claim 7, wherein the speech signal corresponds to a sum of sinusoids of varying amplitudes in frequency domain that extends from a minimum speech signal frequency ($f_{min}$) to a maximum speech signal frequency ($f_{max}$), and further comprising limiting a pitch search for domain space speech signal parameters to a maximum speech search frequency ($f_{search\text{-}max}$) that is less than the maximum speech signal frequency ($f_{max}$).

27. The method according to claim 26, wherein limiting a pitch search for domain space speech signal parameters to a maximum speech search frequency ($f_{search\text{-}max}$) that is less than the maximum speech signal frequency ($f_{max}$) includes limiting the pitch search to a frequency range of about 50-500 Hz.

28. A system for determining a pitch of speech from a speech signal, the system comprising:

(1) a processor structured to:

(a) distinguish the speech signal into voiced, unvoiced or silenced speech signal sections using speech signal energy levels;

(b) apply a windowing procedure to the voiced speech signal section to generate a frame;

(c) apply a Fourier Transform to the frame and obtain speech signal parameters;

(d) determine peaks of the Fourier transformed frame;

(e) select partials by tracking the speech signal parameters of the determined peaks over a plurality of frames of the speech signal to determine trajectories; and (f) determine the pitch from the selected partials using a two-way mismatch error calculation, the two-way mismatch error calculation including:

setting a trial fundamental frequency ($f_{fund}$);

determining a plurality of predicted harmonics corresponding to the trial fundamental frequency;

for one of the plurality of predicted harmonics, determining if any of the selected partials is within ($f_{fund}/2$) of the predicted harmonic;

setting a harmonic frequency error equal to a frequency value of the predicted harmonic in response to determining that none of the selected partials is within ($f_{fund}/2$) of the predicted harmonic; and determining whether to set the pitch equal to the trial fundamental frequency based at least in part on the harmonic frequency error.

29. The system of claim 28, wherein the windowing procedure utilizes a Blackman window, a Kaiser window, a Raised Cosine window or other sinusoidal models.

30. The system of claim 28, wherein the frame is one of a plurality of overlapping frames.

31. The system of claim 28, wherein the signal parameters are tracked over the plurality of frames of the voiced speech signal section.

32. The system of claim 31, wherein the trajectories persisting over more than one frame of the plurality of frames are utilized.

33. The system of claim 28, wherein the Fourier Transform is a Fast Fourier Transform.

34. The system of claim 28, wherein the processor is further adapted to determine peaks of the Fourier transformed frame using a zero padding procedure.

35. The system of claim 28, wherein the processor is further adapted to set a frequency of a determined peak falling within a specified frequency range of a frequency of a harmonic of the pitch equal to the frequency of the harmonic.

36. The system of claim 28, wherein the processor is further configured to select partials from the determined peaks based on a greatest common divisor of a maximum number of partials in the Fourier transformed frame.

37. The system of claim 28, wherein the two-way mismatch error calculation further includes, if a nearest of the selected partials is within ($f_{fund}/2$) of the predicted harmonic, setting the harmonic frequency error equal to an absolute value of a frequency value of the nearest selected partial subtracted from the frequency value of the predicted harmonic.

38. The system of claim 37, the two-way mismatch error calculation further includes:

for one of the selected partials, determining if any of the plurality of predicted harmonics is within ($f_{fund}/2$) of the selected partial;

setting a partial frequency error equal to a frequency value of the selected partial in response to determining that none of the predicted harmonics is within ($f_{fund}/2$) of the selected partial; and determining whether to set the pitch equal to the trial fundamental frequency based at least in part on the partial frequency error.

39. A system for estimating a pitch of speech from a speech signal, the system including:

(1) a memory unit adapted to communicate required data to a processing unit; and (2) the processing unit operating on the speech signal and structured to:

(a) section the speech signal into voiced, unvoiced or silenced sections using speech signal energy levels;

(b) apply a Fast Fourier Transform to the voiced speech signal section and generate speech signal parameters;

(c) determine peaks of the Fourier transformed voiced speech signal section;

(d) select partials by tracking the speech signal parameters of the determined peaks over a plurality of frames of the speech signal to determine trajectories; and (e) calculate the pitch from the selected partials using a two-way mismatch error calculation, the two-way mismatch error calculation including:

setting a trial fundamental frequency ($f_{fund}$);

determining a plurality of predicted harmonics corresponding to the trial fundamental frequency;

for one of the plurality of predicted harmonics, determining if any of the selected partials is within ($f_{fund}/2$) of the predicted harmonic;

setting a harmonic frequency error equal to a frequency value of the predicted harmonic in response to determining that none of the selected partials is within ($f_{fund}/2$) of the predicted harmonic; and determining whether to set the pitch equal to the trial fundamental frequency based at least in part on the harmonic frequency error.

40. The system as claimed in claim 39, wherein the Fast Fourier Transform operates on a frame of a windowed portion of the speech signal.

41. A system for determining a pitch of speech from a speech signal, comprising:

means for obtaining the speech signal;

means for distinguishing the speech signal into voiced, unvoiced or silenced speech signal sections using speech signal energy levels;

means for applying a Fourier Transform to the voiced speech signal section and obtaining speech signal parameters;

means for determining peaks of the Fourier transformed voiced speech signal section;

means for selecting partials by tracking the speech signal parameters of the determined peaks over a plurality of frames of the speech signal to determine trajectories; and means for determining the pitch from the selected partials using a two-way mismatch error calculation, the two-way mismatch error calculation including:

setting a trial fundamental frequency ($f_{fund}$);

determining a plurality of predicted harmonics corresponding to the trial fundamental frequency;

for one of the plurality of predicted harmonics, determining if any of the selected partials is within ($f_{fund}/2$) of the predicted harmonic;

setting a harmonic frequency error equal to a frequency value of the predicted harmonic in response to determining that none of the selected partials is within ($f_{fund}/2$) of the predicted harmonic; and determining whether to set the pitch equal to the trial fundamental frequency based at least in part on the harmonic frequency error.

* * * * *

UNITED STATES PATENT AND TRADEMARK OFFICE

CERTIFICATE OF CORRECTION

PATENT NO. : 7,660,718 B2
APPLICATION NO. : 10/948950
DATED : February 9, 2010
INVENTOR(S) : Prakash Padhi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1137 days.

Signed and Sealed this

Thirtieth Day of November, 2010

David J. Kappos

David J. Kappos
*Director of the United States Patent and Trademark Office*